US005327712A

United States Patent [19]

Dallmann et al.

[11] Patent Number: 5,327,712

[45] Date of Patent: Jul. 12, 1994

[54] METHOD AND APPARATUS FOR INTERMEDIATE YARN STORAGE DURING RENEWED SPUN THREAD JOINING

[75] Inventors: Harold Dallmann, Winterthur; Martin Werder, Zurich; Ernst Ott, Flurlingen, all of Switzerland

[73] Assignee: Maschinenfabrik Rieter AG, Winterthur, Switzerland

[21] Appl. No.: 917,493

[22] Filed: Jul. 21, 1992

[30] Foreign Application Priority Data

Jul. 21, 1991 [CH] Switzerland ..... 02224/91

[51] Int. Cl.[5] ..... D01H 15/00; D01H 1/115

[52] U.S. Cl. ..... 57/22; 57/261; 57/264; 57/352

[58] Field of Search ..... 57/22, 263, 264, 261, 57/352, 328

[56] References Cited

U.S. PATENT DOCUMENTS

| | | | |
|---|---|---|---|
| 4,083,171 | 4/1978 | Konig et al. | 57/34 R |
| 4,944,145 | 7/1990 | Stahlecker | 57/328 |
| 4,958,486 | 9/1990 | Stahlecker | 57/261 |
| 4,972,668 | 11/1990 | Stahlecker | 57/261 |
| 4,995,229 | 2/1991 | Stahlecker | 57/261 |
| 5,044,150 | 9/1991 | Stahlecker | 57/328 |
| 5,079,908 | 1/1992 | Stahlecker | 57/261 |
| 5,094,377 | 3/1992 | Stahlecker | 57/261 X |
| 5,105,613 | 4/1992 | Zott et al. | 57/261 |

FOREIGN PATENT DOCUMENTS

| | | | |
|---|---|---|---|
| 0387009 | 9/1990 | European Pat. Off. . | |
| 3821118 | 12/1989 | Fed. Rep. of Germany | 57/22 |
| 2-169733 | 6/1990 | Japan . | |
| 2136462 | 9/1984 | United Kingdom . | |

*Primary Examiner*—Daniel P. Stodola
*Assistant Examiner*—William Stryjewski
*Attorney, Agent, or Firm*—Wolf, Greenfield & Sacks

[57] ABSTRACT

In a textile spinning apparatus a yarn joining device (12) begins to work to join the end of a newly spun yarn with a retrieved yarn end after the breakage of a yarn (2). During the joining process draw-off rollers (3) continue, to supply the yarn (2) such that yarn storage members (4, 11) have to be implemented during the joining process. In order to draw the yarn (2) into the interior of the yarn storage members (4, 11), air suction is applied in a known manner. After the yarn (2) joining process is completed in the yarn joining device (12), the yarn storage members (4, 11) are successively emptied by use of an acceleration in yarn draw off speed effected by a yarn storage draw-off roller (7) and an auxiliary friction roller (14).

29 Claims, 8 Drawing Sheets

METHOD AND APPARATUS FOR INTERMEDIATE YARN STORAGE DURING RENEWED SPUN THREAD JOINING

BACKGROUND OF THE INVENTION

The present invention relates to a method and apparatus for intermediate yarn or thread storage during piecing or thread joining for a broken yarn upon renewed yarn spinning in a ringless spinning and winding machine, wherein yarn ends are joined by means of gluing, splicing or tying.

The invention relates to the idea of intermediate yarn storage. There are numerous solutions in the art utilizing intermediate yarn storage to provide sufficient time for joining a broken yarn. For example, UK patent application GB 2 136 462 A and German A-document DE 38 17 222 describe such apparatuses and methods. GB 2 136 462 A shows an intermediate yarn storage apparatus consisting of storage tubes which are arranged in series behind one another. Filling and emptying of yarn takes place via a slide valve which controls suction pressure in the individual suction tubes. A disadvantage of such embodiment, however, is that after the splicing process is completed, empty suction tubes must be available for intermediate storage of the supplied yarn because yarn loops reside in the suction tubes and cannot be stored continuously. German disclosure DE 38 17 222 Al proposes different variations based on the same principle illustrated in GB 2 136 462 A and have the same deficiencies.

SUMMARY OF THE INVENTION

In accordance with the invention, there is provided a process and apparatus for intermediate yarn storage during piecing or thread joining of a broken yarn in a ringless spinning and winding machine wherein a newly generated yarn is drawn off from a spinning mechanism, guided into cross-over with a yarn end retrieved from a bobbin on a wind-up device and joined by means of gluing, splicing or tying such that the yarn is guided through yarn storage members provided with suction. During and after the yarn joining process, the travelling yarn is braked, accelerated, and released by two additional effective surfaces such as the nip line of a pair of yarn storage removal rollers disposed between the yarn storage members, the yarn braking, acceleration and releasing actions occurring in timed sequence according to a predetermined program. An advantage of this solution is that upper and lower yarn storage members may be serially disposed behind one another, fully filled and then serially emptied one after the other. The arrangement is simple, in construction and the suction members used to provide suction for the yarn storage members can be arranged at will and without complications by use of rotating suction members, such as, for example, ventilators.

The invention provides a simplified mechanism for effecting twice the yarn storage capacity of conventional systems using a yarn storage member of reduced size or construction.

In accordance with the invention, the yarn temporarily stored during the process is accelerated by an auxiliary friction roller controllably movable into contact with the wind-up bobbin after the yarn is joined. The yarn is then released by the additional effective surfaces, whereby the yarn may then be wound onto the bobbin at a yarn winding speed which is higher than the supply speed of the rollers which draw the yarn being newly spun off from the spinning mechanism. This enables accelerated emptying of the yarn storage members, whereby the increase in the conveying speed may be substantially higher depending on the technical facilities.

Further in accordance with the invention, the temporarily stored yarn is removeable from the upper yarn storage member by increasing the conveying speed of the nip of the storage removal roller to a speed higher than the speed of the draw-off rollers. Thus, in one phase of the process the rollers which draw the newly spun yarn off from the spinning mechanism always supply the yarn at a certain speed to the yarn storage member, the effective surfaces of the yarn storage removal rollers removing the yarn from the yarn storage member at a higher speed than the draw-off speed.

Further in accordance with the invention, the yarn is first sucked into a lower or second serial yarn storage member and subsequently sucked into a first or upper yarn storage member.

Further in accordance with the invention, the yarn storage members are provided in the form of tubes. Such an embodiment for the yarn storage members is economical in configuration because an inner storage space is provided without corners which can be completely filled with the yarn.

Further in accordance with the invention, the yarn storage members are arranged in a common plane in which the course or path of the travelling yarn and the yarn joining device are disposed. Thus, the working paths can be kept short and economical.

Typically, the effective yarn storage removal surfaces comprise a swivelably controllably mounted yarn storage draw-off roller drivably connected to a motor and swivelable into nipping contact with a support roller.

Preferably, at least one yarn storage member is provided with a sensor. Sensors per se are known and may preferably be used to report the filling or emptying of the yarn storage members or act to control further operations.

The lower yarn storage member and the support roller are preferably disposed on the spinning and winding machine. This leads to a practical compact arrangement for the apparatus.

Further in a typical embodiment, the upper yarn storage member, the driven yarn storage draw-off roller, the sensor, the motor with a transmission gear and the auxiliary friction roller are integrated into a displaceable piecing robot which is controllably movable along the length of the spinning and winding machine.

The auxiliary friction roller can also be employed in a known manner, for reversing the bobbin to search for a broken yarn end thereon to be ultimately joined with the end of a yarn being spun upon renewal spinning after a thread breakage or a restarting of spinning.

The auxiliary friction roller typically includes a clutch mechanism. Such a mechanism enables a smooth transition in the rate of travel of the yarn from the discharging speed to the winding speed, whereby the clutch can also be employed to switch off the auxiliary winding function.

BRIEF DESCRIPTION OF THE DRAWINGS

Exemplary embodiments of the present invention are described in detail below with reference to the accompanying drawings. Analogous components are labeled in all Figures with the same reference numbers.

DETAILED DESCRIPTION OF PREFERRED EMBODIMENTS

Figure 1:
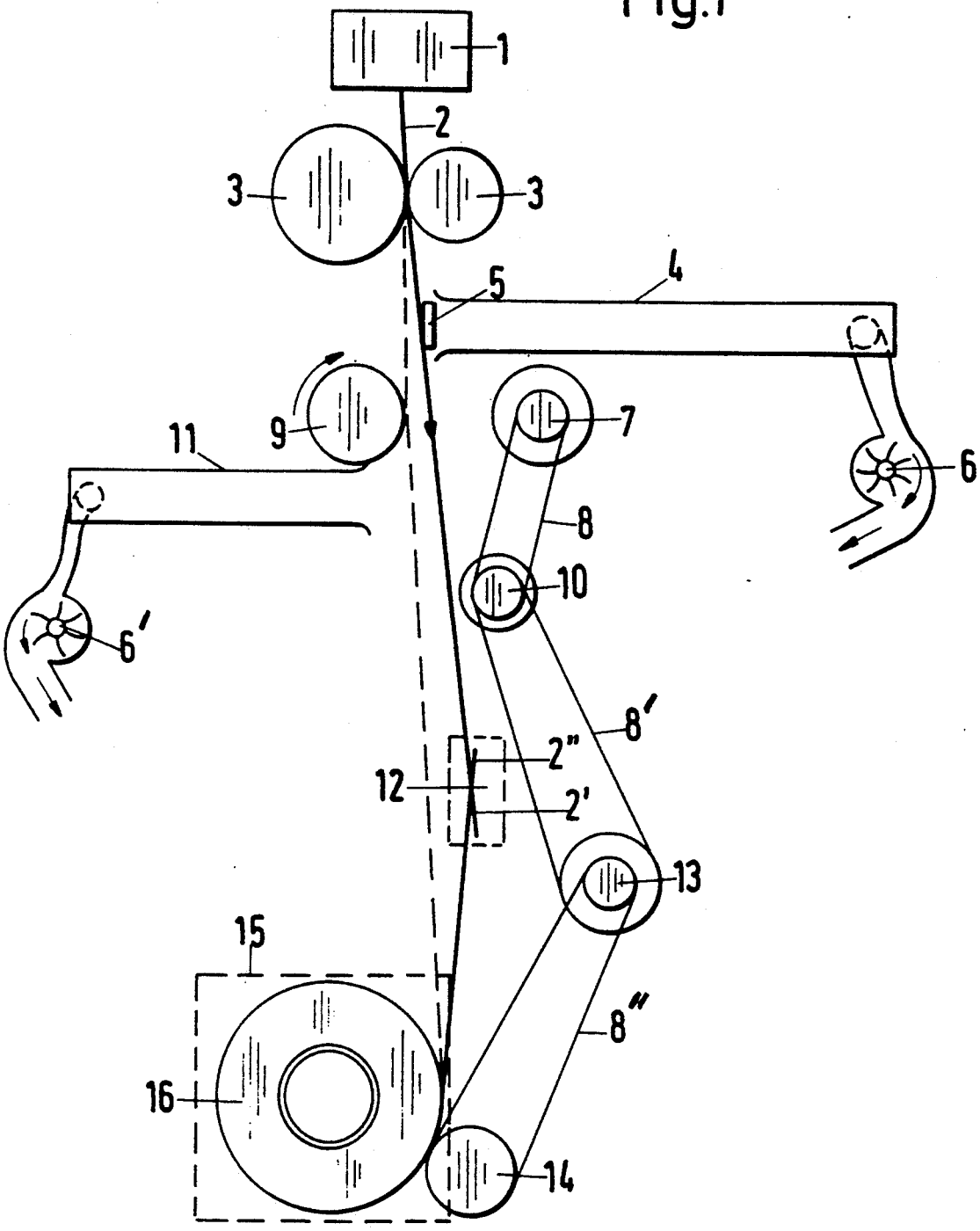
FIG. 1 is a schematic view of the apparatus in accordance with the invention at an initial point in the process where a broken thread end and a newly spun thread end are brought together for eventual joining.

The apparatus as shown in FIG. 1 includes a ringless spinning member or device 1. Reference number 2 indicates an overall yarn having a newly formed yarn end 2' which has been guided into yarn joining device 12 and crosses a broken yarn end 2" which has been obtained from a spun yarn on the bobbin 16, the two yarn or thread ends 2', 2" to be joined in the area of the yarn joining device 12 forming overall yarn 2. Disposed after or beneath the ringless spinning member 1 are a pair of draw-off rollers 3 which convey the yarn 2 at a selected draw-off speed in the direction of travel of yarn 2 shown by the arrow head, FIG. 1. An upper yarn storage member 4 is provided with a sensor 5 and is disposed below the draw-off rollers 3. The outer or distal end of the upper yarn storage member 4 is provided with an air suction member 6 for temporarily drawing a loop of yarn into member 4 as described below. A yarn storage draw-off roller 7 is provided. The roller 7 is swivelably mounted and drivably connected by such means as, for example, a belt 8 to a motor 10 having a transmission gear. A rotatable non-swivelable or fixed support roller 9 is mounted opposite the swivelable yarn storage draw-off roller 7. A lower yarn storage member 11 is disposed serially after or below the support roller 9 and extends distally from the nip area of rollers 7, 9. Storage member 11 is also provided with an air suction member 6' for temporarily drawing a loop of yarn into member 11 as described below. Belts 8 , 8 lead from the motor 10 via a gear 13 to another auxiliary roller 14 which is controllably drivably rotatable for rotating wind-up bobbin 16. In the lower most section of the apparatus, the yarn bobbin 16 is mounted in a winding unit 15.

Figure 2:
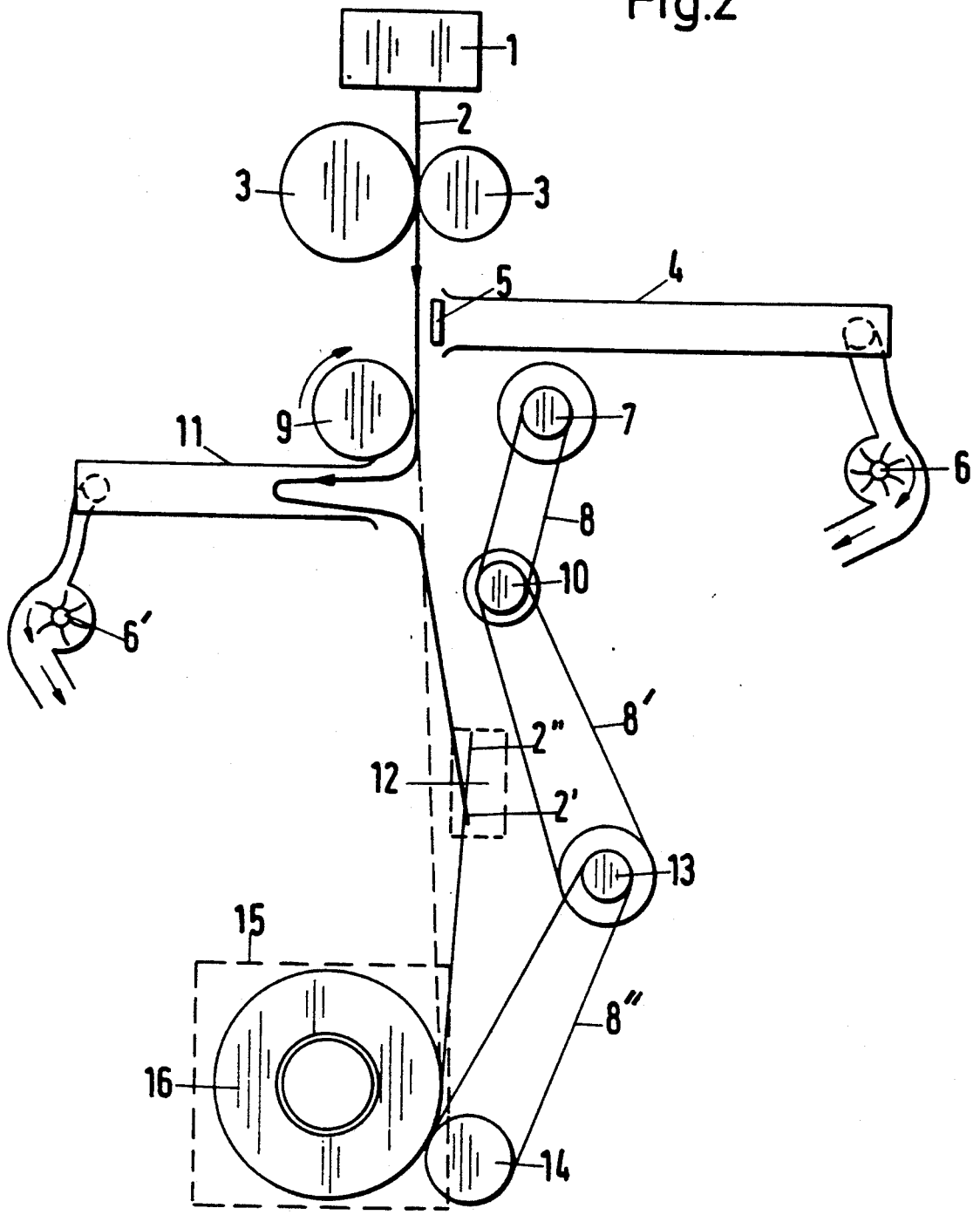
FIG. 2 is a view of the FIG. 1 apparatus at a subsequent point in the process where a lower yarn storage member is initially being filled.
Figure 3:
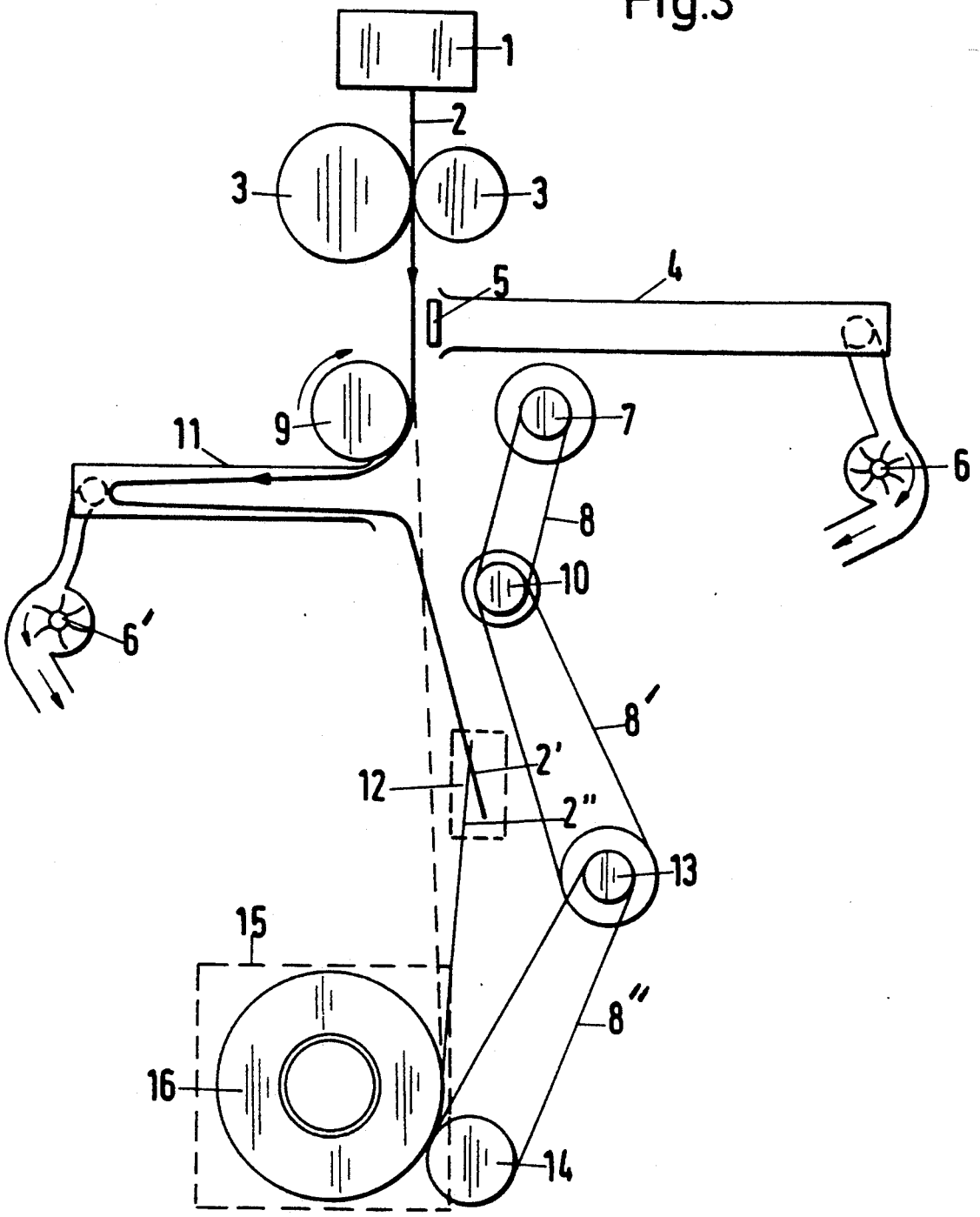
FIG. 3 shows a phase in the process subsequent to FIG. 2 where the lower yarn storage member is completely filled with a yarn loop.
Figure 4:
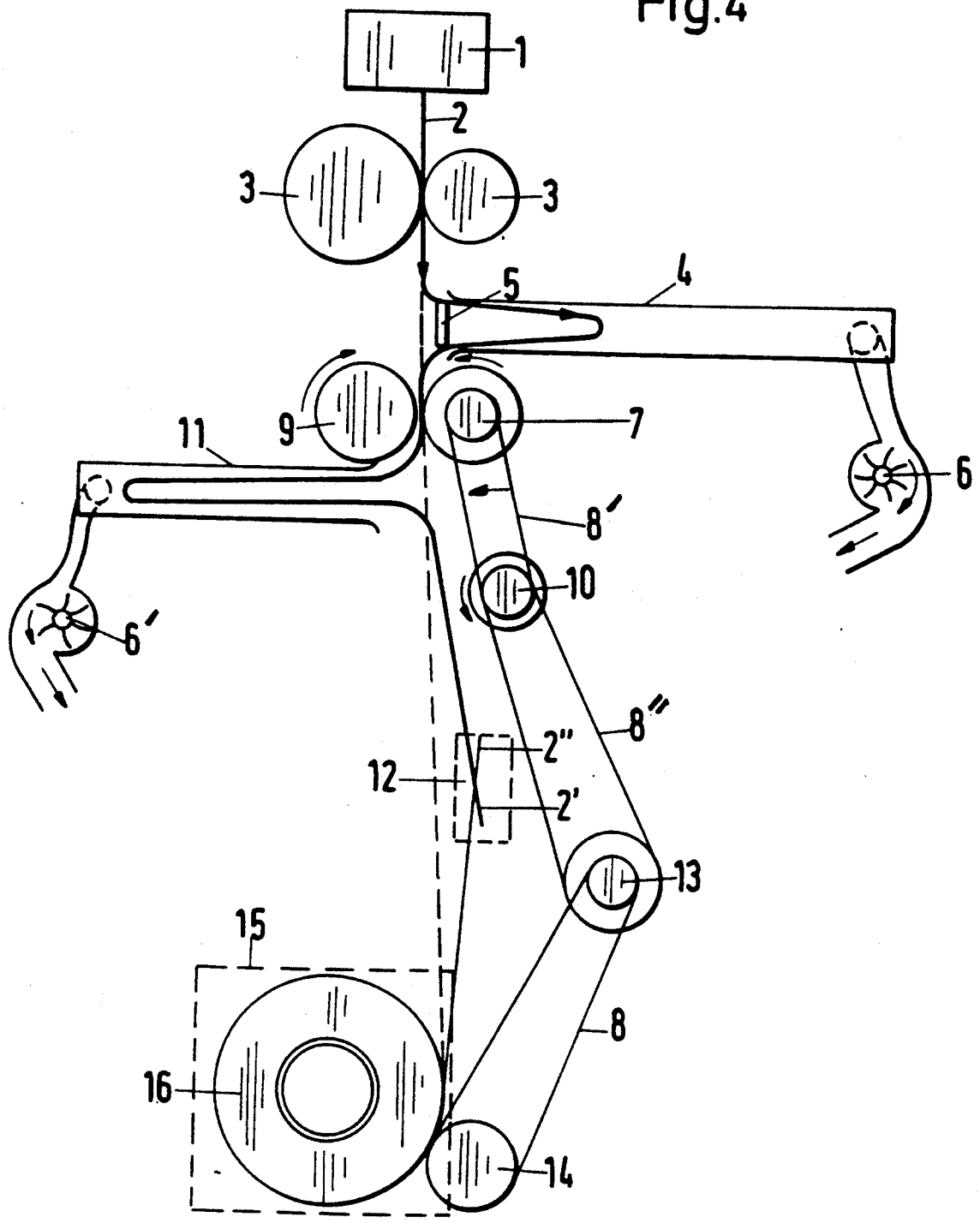
FIG. 4 shows a phase subsequent to FIG. 3 where a yarn storage draw-off roller is pressed onto a support roller clamping and braking the yarn whereby an upper or first yarn storage member is filled.
Figure 5:
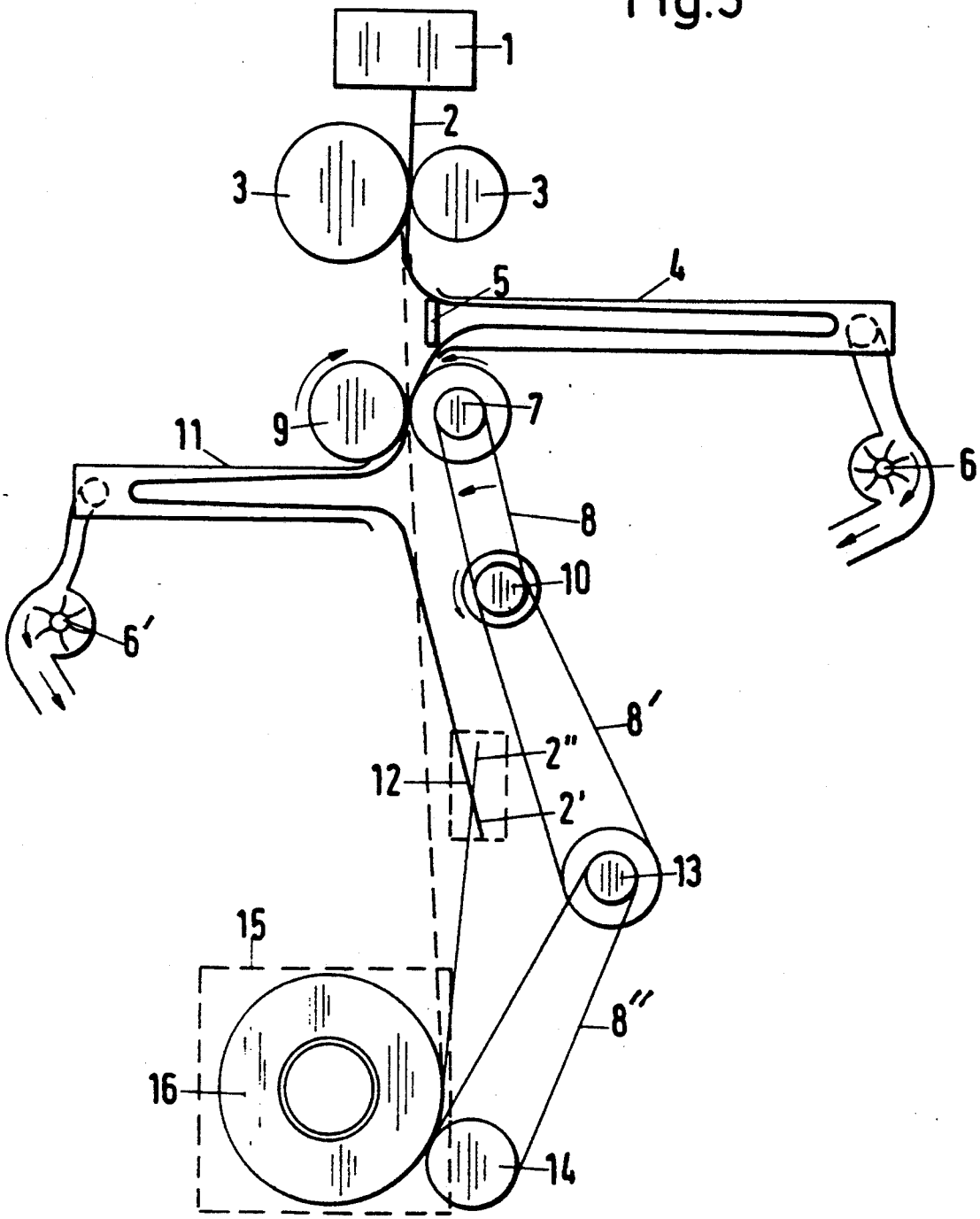
FIG. 5 shows a phase subsequent to FIG. 4 where the upper yarn storage member has been completely filled and, in the meantime, the broken yarn has been completely joined in a yarn joining device.
Figure 6:
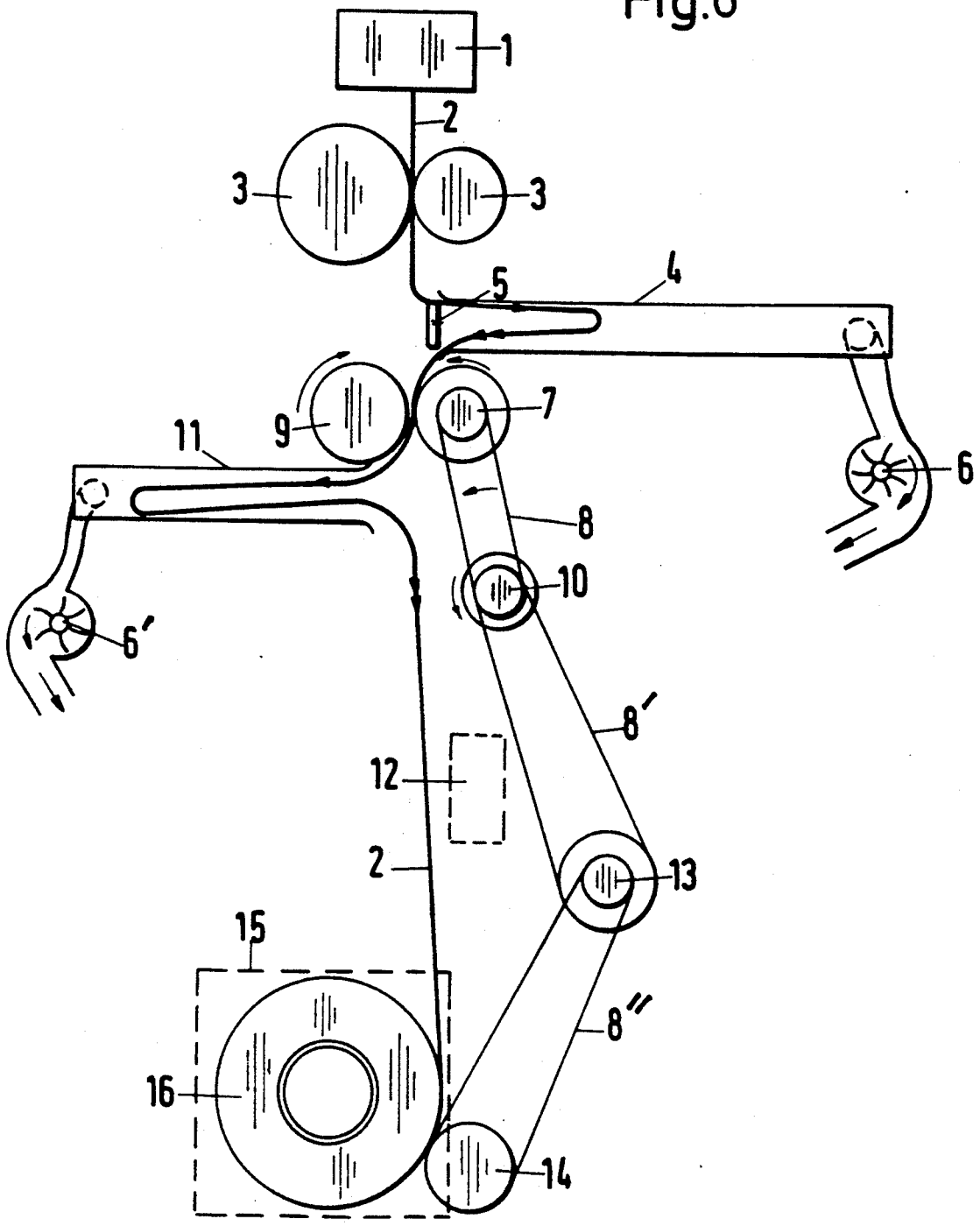
FIG. 6 shows a phase subsequent to FIG. 5 where the yarn has been released from the yarn joining device and the speed of yarn winding onto a wind-up spool is increased, the yarn storage draw-off roller 7 and the support roller simultaneously conveying the yarn at the same accelerated speed.

As shown in FIG. 1, neither of the two yarn storage members 4 and 11 have yet received or are filled with yarn. Initially in the process of renewed spinning and thread joining, the lower yarn storage member 11 is filled first as shown in FIG. 2 by timed actuation of suction mechanism 6'. The rate of filling of member 11 takes place depending on the supply speed of rollers 3, i.e., the length of the loop received within tube 11 grows at about half the supply speed of draw-off rollers 3 and spinning device 1. The yarn loop received within storage tube 11 is tensioned by the suction air from suction member 6', such that no random orientation of the yarn fibres can occur, the suction force within tube 11 being effected by suction member 6'. In the serial phase shown in FIG. 3 the lower yarn storage member 11 is already completely filled. The yarn joining process being carried out in the yarn joining device 12 is still under way at this point, FIG. 3. In accordance with the invention, approximately 60% of the yarn joining time has elapsed as of achievement of the position in FIG. 3. The yarn storage draw-off roller 7 is then pressed against the support roller 9, FIG. 4 forming a nip or clamping line. At this point, roller 7 is not yet rotatably driven, the travel of the yarn 2 being temporarily braked below the nip line of rollers 7,9. Simultaneously with the non-moving clamping between rollers 7,9, a suction is applied by member 6 to the upper yarn storage member 4 which receives yarn delivered by rollers 3 in form of a loop as shown. As shown in FIG. 5, the upper yarn storage member 4 is eventually completely filled with a loop of yarn and, at about the same time as the tube 4 is filled, the yarn connection between yarn ends 2' and 2" has been effected. As shown in FIG. 6, the joined yarn 2 has been next released by the yarn joining device 12. Shortly thereafter the auxiliary friction roller 14 begins to turn bobbin 16 and accelerates it to a high yarn winding speed higher than the supply speed of the draw-off rollers 3. Simultaneously with acceleration of the winding by roller 14, roller 7 is rotatably driven, FIGS. 5, 6 and the nip line or effective removal surfaces between the yarn storage draw-off roller 7 and the support roller 9 convey the yarn at the same speed as the winding speed at the bobbin winding head 16. Thus, the upper yarn storage member 4 begins to be emptied first.

Figure 7:
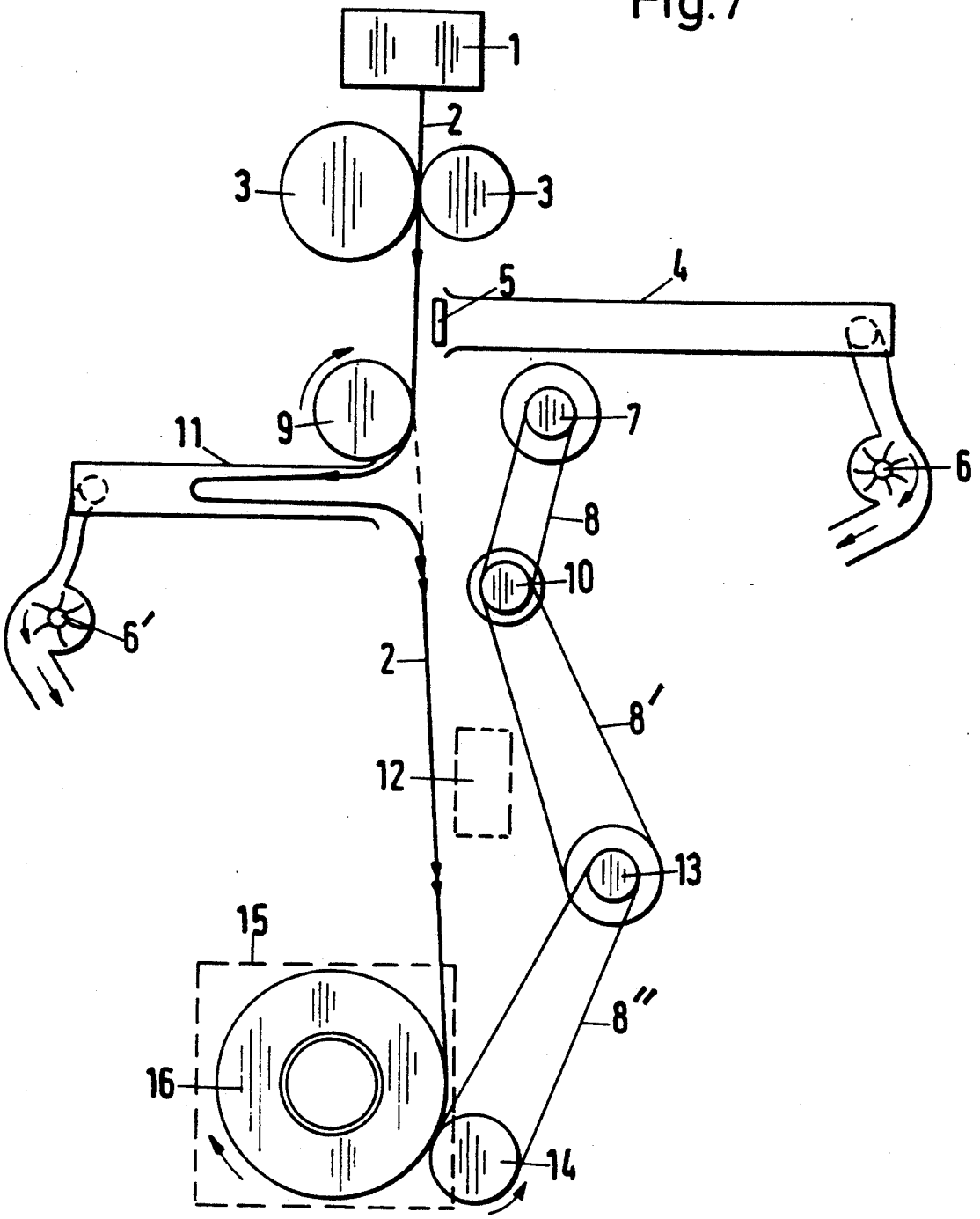
FIG. 7 shows a phase subsequent to FIG. 6 where a sensor detects the emptying of the upper yarn storage member and sends a signal such that emptying of the lower yarn storage member is initiated at an increased speed.

Next, as shown in FIG. 7, the sensor 5 signals the emptying of the upper yarn storage member 4 and the yarn storage draw-off roller 7 is then swivelably retracted to its rest position and stopped in response to the signal. Motor 10 continues to drive the yarn bobbin 16 via gear 13 and auxiliary friction roller 14 at a speed higher than the speed of yarn loop formation in the lower yarn storage member 11 thus causing the yarn loop in tube 11 to continuously become shorter. The lower yarn storage member 11 continues to suck in newly formed yarn 2 at least during the course of operations described with reference to FIGS. 5, 6, 7.

Figure 8:
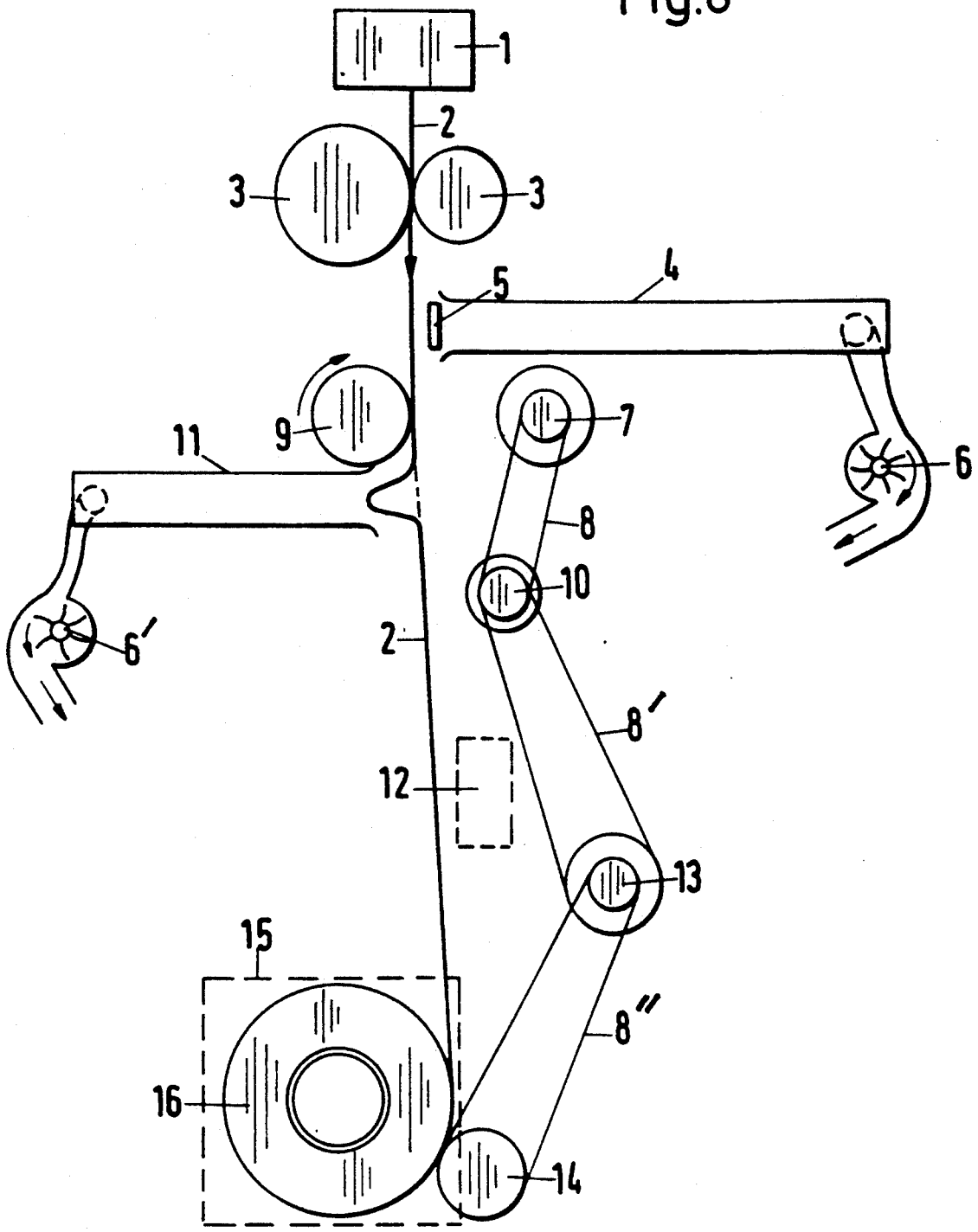
FIG. 8 shows a final phase subsequent to FIG. 7 where only a small loop of the yarn is left remaining within the lower yarn storage member.

As shown above in FIG. 8, the yarn loop in the lower yarn storage member 11 eventually becomes very short. At this time the circumferential speed of the auxiliary friction roller 14, which has been highly increased with respect to the draw-off rollers 3, is reduced, such that the winding speed of yarn 2 is only slightly higher than the draw-off speed of rollers 3 and such that the lower yarn storage member 11 is fully emptied in a very careful manner. When the tube 11 is completely emptied the air suction in the yarn storage member 11 may then be turned off completely and the spinning and winding machine may be returned to the normal spinning and winding machine operational conditions after the auxiliary friction roller 14 has been turned off and the normal friction drive for the bobbin 16 (not shown) has been switched on.

In a typical embodiment of the apparatus, the joining device 12, storage member 4 and associated sensor 5 and suction device 6, storage removal roller 7, auxiliary wind-up friction roller 14 and associated motor 10, transmission gears, belts 8, 8', 8'' and the like are provided or mounted on a service robot movably mounted on the spinning and winding machine.

There are alternative embodiments to the embodiments mentioned above. For example, both of the yarn storage members may be provided on a piecing or thread joining or splicing robot or both of the yarn storage members may be provided on the spinning and winding machine 15. The drive of the auxiliary friction roller 14 may include a clutch, such that a smooth, continuous transition from the accelerated emptying speed to the winding speed of normal spinning is enabled. Such a clutch mechanism may also be utilized to control the filling of the two yarn storage members.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. In a textile spinning apparatus comprising a spinning machine wherein a yarn is renewably spun by a spinning mechanism and drawn off at a selected speed for eventual take up on a winding device, and wherein the yarn is guided along a selected path of travel and joined in a joining mechanism with a yarn end retrieved from the yarn winding device, a method for temporarily storing the travelling yarn during the course of the joining operation in first and second suction storage members, the method comprising guiding the travelling yarn past the first suction storage member which is downstream of the spinning mechanism and upstream of the joining mechanism and the second storage member which is downstream of the first storage member and upstream of the joining mechanism after filling the second suction storage member with yarn to a predetermined level braking the travelling yarn at a position between the storage members within the nip of a pair of control rollers such that the travelling yarn is suctionably stored in the first storage member and then subsequently accelerating the travel of the yarn via the control rollers to remove the yarn stored in the first storage member for controlled delivery to the winding device.

2. The method of claim 1 wherein the thread joining operation is selected from the group consisting of gluing, splicing and tying.

3. The method of claim 1 further comprising releasing the travelling yarn from the nip of the control rollers after removal of the stored yarn wherein the joined yarn is wound onto the winding device at a winding speed greater than the selected speed at which the newly spun yarn is being drawn off.

4. The method of claim 3 wherein the winding device comprises a rotatable bobbin onto which the joined yarn is wound, the bobbin being rotatable at selectively controllable speeds by an auxiliary friction roller controllably drivable at selected speeds.

5. The method of claim 4 wherein the yarn storage members comprise hollow tubes suctionably receiving the newly spun yarn within the tubes as the yarn is being drawn off.

6. The method of claim 5 wherein the control rollers comprise a rotatable support roller and a yarn storage draw off roller controllably swivelable into clamping contact with the support roller and controllably driveable at selected draw off speeds according to the predetermined program.

7. The method of claim 3 wherein the newly spun yarn guided into the first yarn storage member is removed from the first yarn storage member by the control rollers at a yarn removal speed greater than the selected draw-off speed.

8. The method of claim 1 wherein the yarn is first guided by air suction into the second yarn storage member and guided subsequently by air suction into the first yarn storage member.

9. The method of claim 1 wherein the yarn storage members comprise hollow tubes suctionably receiving the newly spun yarn within the tubes as the yarn is being drawn off.

10. The method of claim 9 wherein the yarn storage tubes are disposed in a plane common with the path of the yarn and the yarn joining mechanism.

11. The method of claim 9 wherein the control rollers comprise a rotatable support roller and a yarn storage draw off roller controllably swivelable into clamping contact with the support roller and controllably drivable at selected draw off speeds according to the predetermined program.

12. The method of claim 11 wherein the support roller and the second yarn storage member are mounted on the spinning machine.

13. The method of claim 9 wherein at least one of the yarn storage members includes a means for sensing the presence of yarn received within the tube, the means for sensing including means for sending a signal controlling continued delivery of the joined yarn to the winding device.

14. In a textile spinning apparatus comprising a spinning and winding machine, an apparatus for storing yarn being spun and delivered to a yarn winding device during the course of a yarn end joining operation, the apparatus comprising a spinning mechanism for spinning a new yarn from a newly delivered sliver, a mechanism for drawing the new yarn off at a selected speed in a path of travel toward the winding device, first and second yarn storage members disposed successively downstream of the spinning mechanism along the path of yarn travel, a yarn end joining mechanism disposed downstream of the storage members and a mechanism for controlling the travel of the yarn, the travel control mechanism nipping with rollers the travelling yarn at a position between the first and second storage members and being programmed to brake the travel of the yarn, after the second suction storage member is filled with yarn to a predetermined level, for a predetermined period of time such that the travelling yarn is suctionably stored within the first storage member during the yarn end joining operation and programmed to accelerate the travel of the yarn after the braking such that the stored yarn is removed from the first storage member and delivered to the winding mechanism.

15. The apparatus of claim 14 wherein the yarn storage members comprise hollow tubes each including an air suction mechanism for suctionably drawing a loop of travelling yarn into the tubes in a predetermined sequence.

16. The apparatus of claim 15 wherein the yarn storage tubes and the yarn end joining mechanism are disposed in a plane common with the path of yarn travel.

17. The apparatus of claim 15 wherein the yarn travel control mechanism comprises a fixed rotatable support roller and a roller controllably swivelable into and out of yarn nipping engagement with the support roller, the swivelable roller being rotatably drivable at selected speeds according to a predetermined sequence.

18. The apparatus of claim 17 wherein the yarn travel control mechanism includes means for braking the course of yarn travel such that the first yarn storage member suctionably receives a loop of travelling yarn.

19. The apparatus of claim 18 wherein the yarn travel control mechanism includes means for successively braking the course of yarn travel and accelerating the course of yarn travel according to the predetermined sequence.

20. The apparatus of claim 17 wherein the yarn travel control mechanism includes means for successively braking the course of yarn travel and accelerating the course of yarn travel according to the predetermined sequence.

21. The apparatus of claim 15 wherein the yarn storage tubes and the yarn end joining mechanism are disposed in a plane common with the path of yarn travel.

22. The apparatus of claim 14 wherein the yarn travel control mechanism comprises a fixed rotatable support roller and a roller controllably swivelable into and out of yarn nipping engagement with the support roller, the swivelable roller being rotatably derivable at selected speeds according to a predetermined sequence.

23. The apparatus of claim 22 wherein the yarn storage tubes and the yarn end joining mechanism are disposed in a plane common with the path of yarn travel.

24. In a textile spinning machine wherein yarn spinning and wind-up is begun by joining a yarn end from a newly spun yarn with a yarn end retrieved from a spun yarn on a yarn winding device, the newly spun yarn being continuously drawn off and delivered along a path of travel to the winding device during the course of yarn end joining in a joining device, a method for temporarily storing the continuously drawn off yarn during the course of yarn end joining comprising guiding the newly spun yarn being drawn off past a first downstream yarn suction storage member and a second downstream yarn storage member, the yarn end joining device being downstream of the storage members, braking the travel of the yarn being drawn off with rollers at a position between the storage members such that the yarn being drawn off is suctionably stored in the first storage member, after the second suction storage member is filled with yarn to a predetermined level, during the course of thread joining operations and then subsequently accelerating with rollers the travel of the yarn at the position between the storage members after the yarn joining operations are completed to remove the yarn stored in the first storage member.

25. The method of claim 24 wherein the first and second yarn storage members are successively disposed along the path of yarn travel and suctionably receive a predetermined length of the continuously drawn off yarn in a predetermined sequence.

26. The method of claim 25 wherein the travel of the yarn is braked, accelerated and released at a yarn nipping point disposed between the first and second yarn storage members.

27. The method of claim 26 wherein the travel of the yarn is braked such that a predetermined length of the continuously drawn off yarn is first received and stored within the second storage member and a predetermined length of the continuously drawn off yarn is subsequently received and stored within the first yarn storage member.

28. The method of claim 27 wherein the yarn stored within the first storage member is removed by accelerating the travel of the yarn at the nipping point between the storage members to a speed greater than the continuous draw off speed.

29. The method of claim 28 wherein the winding device rotates to wind up the yarn at the same time and at the same speed as the travel of the yarn is accelerated at the nipping point.

* * * * *